US005586758A

United States Patent [19]

Kimura et al.

[11] Patent Number: 5,586,758

[45] Date of Patent: Dec. 24, 1996

[54] SHEET DISCHARGE APPARATUS AND IMAGE FORMING APPARATUS HAVING SUCH SHEET DISCHARGE APPARATUS

[75] Inventors: Shoji Kimura, Kawasaki; Nobukazu Adachi, Yokohama, both of Japan

[73] Assignee: Canon Kabushiki Kaisha, Tokyo, Japan

[21] Appl. No.: 396,643

[22] Filed: Mar. 1, 1995

[30] Foreign Application Priority Data

Mar. 3, 1994 [JP] Japan ..... 6-060356

[51] Int. Cl.[6] ..... B65H 39/10

[52] U.S. Cl. ..... 271/303; 271/65; 271/186; 271/207

[58] Field of Search ..... 271/303, 65, 186, 271/207

[56] References Cited

U.S. PATENT DOCUMENTS

| | | | |
|---|---|---|---|
| 4,750,016 | 6/1988 | Kusumoto et al. | 271/65 |
| 5,161,794 | 11/1992 | Adachi . | |
| 5,234,213 | 8/1993 | Chen | 271/186 |

FOREIGN PATENT DOCUMENTS

| | | | |
|---|---|---|---|
| 0041348 | 2/1988 | Japan | 271/303 |
| 404023763 | 1/1992 | Japan | 271/303 |
| 404308148 | 10/1992 | Japan | 271/303 |
| 405051160 | 5/1993 | Japan | 271/303 |

*Primary Examiner*—H. Grant Skaggs
*Attorney, Agent, or Firm*—Fitzpatrick, Cella, Harper & Scinto

[57] ABSTRACT

The sheet discharge apparatus includes a first sheet discharge path for discharging a sheet and a second sheet discharge path for discharging the sheet. The apparatus further includes a sheet stacking tray on which the sheets discharged through the second sheet discharge path and which is pivotally mounted on a body of the apparatus, a reverse rotation guide rotatably supported by the sheet stacking tray and forming a part of the first sheet discharge path, and a holder for holding the reverse rotation guide in a position where the reverse rotation guide forms a part of the first sheet discharge path in a condition that the sheet stacking tray is closed with respect to the body of the apparatus and for releasing the reverse rotation guide to permit the reverse rotation guide to thereby retard to a retard position where the reverse rotation guide is retarded from a stacking surface of the sheet stacking tray not to prevent the sheet from being directed in the sheet stacking tray.

22 Claims, 11 Drawing Sheets

SHEET DISCHARGE APPARATUS AND IMAGE FORMING APPARATUS HAVING SUCH SHEET DISCHARGE APPARATUS

BACKGROUND OF THE INVENTION

1. Field of the Invention

The present invention relates to a sheet discharge apparatus for discharging a cut sheet (referred to as merely "sheet" hereinafter) on which an image was formed, and an image forming apparatus such as a copying machine, a printer, a facsimile and the like having such a sheet discharge apparatus, and more particularly, it relates to a sheet discharge apparatus wherein a sheet on which an image was formed in a face-down manner is discharged in a face-down manner or a face-up manner after inversion, and an image forming apparatus having such a sheet discharge apparatus.

2. Related Background Art

In the past, in sheet discharge apparatuses used with image forming apparatuses such as printers, face-down discharge (FIG. 9) in which a sheet on which an image was formed is discharged with an imaged surface thereof facing downwardly or face-up discharge (FIG. 10) in which a sheet on which an image was formed is discharged with an imaged surface thereof facing upwardly is adopted.

As shown in FIG. 9, in a printer having a face-down sheet discharge apparatus, sheets are supplied one by one from a sheet cassette 2 to an image forming portion 4 by means of a sheet supply roller 3, and an image is formed on an upper surface of the sheet in the image forming portion. The sheet S on which the image was formed is inverted by a pair of discharge rollers 5 and a reverse rotation guide 6 and then is discharged onto a sheet stacking portion 9 through a pair of rollers 7 with the imaged surface A facing downwardly. The face-down discharge method is particularly useful for compact printers since the imaged sheets can be stacked in a page sequence and the discharge sheet stacking portion 9 can be formed on a body 8 of the printer to save installation space.

On the other hand, as shown in FIG. 10, in a printer having a face-up sheet discharge apparatus, the sheet S on which the image was formed in the image forming portion 4 in the same manner is discharged onto a sheet stacking tray 10 through the pair of discharge rollers 5 with the imaged surface A facing upwardly. Although this face-up discharge method cannot save installation space since the sheet stacking tray protrudes laterally from the printer body 8, the imaged information on the sheet can easily be ascertained since the sheet is discharged with the imaged surface A facing upwardly.

In consideration of the above, as shown in FIG. 11, there has been proposed a sheet discharge apparatus 11 wherein the face-down discharge and the face-up discharge can be switched. In this sheet discharge apparatus, a switching guide 12 is disposed at a downstream side of the pair of discharge rollers 5 and can be rotated around a fulcrum 12*a* by a predetermined amount by means of an operation lever or an actuator such as a solenoid. With this arrangement, the imaged sheet discharged through the discharge rollers 5 can selectively be directed toward the reverse rotation guide 6 or toward the sheet stacking tray 10. FIG. 12 shows a condition that the switching guide 12 is switched to direct the sheet toward the tray 10. In this case, the sheet S discharged through the discharge rollers 5 is discharged onto the sheet stacking tray 10 with the imaged surface A facing upwardly (face-up discharge). On the other hand, FIG. 13 shows a condition that the switching guide 12 is switched to direct the sheet toward the reverse rotation guide 6. In this case, the sheet S discharged through the discharge rollers 5 is discharged onto the sheet stacking portion 9 through the reverse rotation guide 6 and the pair of rollers 7 with the imaged surface A facing downwardly (face-down discharge).

Further, as shown in FIGS. 14A and 14B, there has also been proposed a sheet discharge apparatus wherein a side plate 33 is pivotally mounted on a support pin 34 and a switching guide 32 is pivotally mounted on an upper portion of the side plate via a pin 35.

In this sheet discharge apparatus, as shown in FIG. 14A, under a condition that the switching guide 32 is folded with respect to the side plate 33 and the side plate 33 is closed, the sheet discharged through the discharge rollers 5 is guided by a reverse rotation surface 32*a* formed on the switching guide to be discharged onto the sheet stacking portion 9 in the face-down manner. On the other hand, as shown in FIG. 14B, under a condition that the side plate 33 is opened and the switching guide 32 is rotated with respect to the side plate 33, the sheet discharged through the discharge rollers 5 is guided by a tray surface 33*a* formed on the side plate 33 and a tray surface 32*a* formed on the switching guide 32 and is discharged in the face-up manner.

However, the sheet discharge apparatus having the switching guide requires the switching guide 12 and the operation lever or the actuator for driving the switching guide, thereby making the printer complex, and, due to the presence of the switching guide, the occurrence of sheet jam will be increased. Further, since it is difficult for the operator to judge whether the switching guide 12 is switched to direct the sheet toward the tray or the reverse rotation guide, malfunction will easily occur (for example, the operator erroneously selects the face-down mode in place of the face-up mode or vice versa).

Further, when the apparatus is made compact by adopting the face-down sheet discharge, although it is necessary to dismount the sheet stacking tray from the apparatus and to preserve it anywhere, a new reserving space for the dismounted sheet stacking tray is required, and there is a danger of misplacing the sheet stacking tray. Further, since there is the switching guide 12 within the apparatus, if the sheet is jammed in the proximity of the discharge rollers 5, it is difficult to remove the jammed sheet due to the presence of the switching guide 12. In addition, when the path is switched to prevent the sheet from being caught, since the accurate rocking angle of the switching guide 12 is required, it takes a long time to assemble the apparatus.

On the other hand, in the conventional apparatus shown in FIGS. 14A and 14B, since the switching guide 32 can be extended out of the apparatus, the jammed sheet can easily be removed. However, in this case, since the guide surface 32*a* is exposed, the guide surface 32*a* may be damaged.

Incidentally, the above problems arise in the image forming apparatus having one of the above mentioned sheet discharge apparatus.

SUMMARY OF THE INVENTION

An object of the present invention is to provide a sheet discharge apparatus and an image forming apparatus having such a sheet discharge apparatus, wherein a sheet discharging direction can be switched by opening and closing a sheet stacking tray with respect to a body of the apparatus, whereby the above-mentioned conventional drawbacks can be eliminated by omitting any switching guide.

Another object of the present invention is to provide a sheet discharge apparatus and an image forming apparatus having such a sheet discharge apparatus, wherein a reverse rotation guide can positively be switched to perform face-down discharge or face-up discharge so that a discharging direction of a sheet can be ensured.

A further object of the present invention is to provide a sheet discharge apparatus and an image forming apparatus having such a sheet discharge apparatus, wherein, when a sheet stacking tray is opened, a reverse rotation guide is positively rotated to a retard position where the guide does not prevent a sheet from being directed to the sheet stacking tray, whereby the reverse rotation guide is positively shifted to the retard position to stack the sheets on the sheet stacking tray.

A still further object of the present invention is to provide a sheet discharge apparatus and an image forming apparatus having such a sheet discharge apparatus, wherein an extension tray is provided in connection with a sheet stacking tray so that a sheet discharging direction can be changed automatically and positively by using the extension tray.

Yet another object of the present invention is to provide a sheet discharge apparatus and an image forming apparatus having such a sheet discharge apparatus, wherein a sheet discharging direction can be changed with a simple construction by lacking a reverse rotation guide by means of a locking means.

To achieve the above objects, according to the present invention, there is provided a sheet discharge apparatus comprising a first sheet discharge path for discharging a sheet, and a second sheet discharge path for discharging the sheet, a sheet stacking tray on which the sheets from the second sheet discharge path and which is pivotally mounted on a body of the apparatus, a reverse rotation guide rotatably supported by the sheet stacking tray and forming a part of the first sheet discharge path, and a holding means for holding the reverse rotation guide in a position where the reverse rotation guide forms a part of the first sheet discharge path in a condition that the sheet stacking tray is closed with respect to the body of the apparatus and for releasing the reverse rotation guide to permit the reverse rotation guide to retard to a retracted position where the reverse rotation guide is retarded from a stacking surface of the sheet stacking tray not to prevent the sheet from being directed to the sheet stacking tray.

For example, the first sheet discharge path serves to discharge the sheet with a first surface thereof facing downwardly, and the second sheet discharge path serves to discharge the sheet with a first surface thereof facing upwardly.

Incidentally, although the first surface of the sheet is normally the imaged surface, the first surface is not limited to this, but may be a non-imaged surface or is one of both imaged surfaces.

Preferably, there is provided a positive shifting means for holding the sheet stacking tray in an opened condition with respect to the body of the apparatus and for positively shifting the reverse rotation guide to the retard position where the sheet from the second sheet discharge path is not prevented from being directed to the sheet stacking tray.

Further, an extension tray may be provided in connection with the sheet stacking tray so that, when the extension tray is retracted, it holds the reverse rotation guide, and, when the extension tray is extended, the reverse rotation guide can be retarded. Particularly, it is preferable that the extension tray is slidably mounted on the sheet stacking tray, and a protruded portion is provided on the extension tray and a projection is provided on the reverse rotation guide so that, when the extension tray is shifted from the retracted position to the extended position, the protruded portion abuts against the projection to positively shift the reverse rotation guide to the retard position.

It is desirable that there is provided a regulating means for holding the extension tray to the retracted position when the sheet stacking tray is closed with respect to the body of the apparatus.

Further, there is provided a lock means capable of locking the reverse rotation guide to the body of the apparatus, and the lock means constitutes the holding means. Particularly, it is preferable that the lock means comprises a lock portion provided on the reverse rotation guide and a biasing means for biasing the reverse rotation guide to the position where the reverse rotation guide does not prevent the sheet from being directed to the sheet stacking tray, and, when the lock portion is locked to the body of the apparatus in opposition to a biasing force of the biasing means, the reverse rotation guide is held at the position where the reverse rotation guide forms a part of the first sheet discharge path.

Further, there is provided a positioning means for positioning the sheet stacking tray to a sheet stacking position where the sheets from the second sheet discharge path can be stacked, and the sheet stacking tray may be further opened from the sheet stacking position.

The present invention can similarly be applied to an image forming apparatus comprising an image forming portion and a sheet discharge apparatus for discharging a sheet on which an image was formed in the image forming portion.

With the arrangement as mentioned above, the sheet on which the image was formed in the image forming portion is directed to the sheet discharge apparatus and is discharged out of the image forming apparatus through the first or second sheet discharge path. When the sheet is discharged through the first sheet discharge path, the sheet stacking tray is closed and locked with respect to the body of the apparatus. In this condition, the reverse rotation guide is held by the holding means to the position where the reverse rotation guide forms a part of the first sheet discharge path. The sheet is guided by the reverse rotation guide and the like and is discharged with the image surface thereof facing downwardly.

On the other hand, when the sheet is discharged through the second sheet discharge path, the sheet stacking tray is opened with respect to the body of the apparatus. In this condition, the reverse rotation guide is released from the holding means and is shifted to the retard position by its own weight, the biasing means or the positive shifting means, with the result that the sheet is not blocked by the reverse rotation guide and is discharged onto the sheet stacking tray.

According to the present invention, by opening and closing the sheet stacking tray, the sheet discharge through the first sheet discharge path and the sheet discharge through the second sheet discharge path can be switched. Thus, since any switching guide can be omitted, the sheet discharging direction can be changed positively with the simple construction, and the occurrence of the sheet jam can be reduced.

Further, since the sheet discharging direction is automatically selected by opening and closing the sheet stacking tray, the operator does not manipulate the apparatus erroneously. When the first sheet discharge path is used, since the sheet stacking tray is held in the closed position, the tray is not misplaced.

Further, in the condition that the sheet stacking tray is closed, since the reverse rotation guide is held by the holding means to the position where the reverse rotation guide forms a part of the first sheet discharge path, the sheet can positively be discharged through the first sheet discharge path. Since there is no switching guide in the apparatus, a sheet jammed in the proximity of the discharge rollers can easily be removed.

Unlike to the sheet discharging direction effected by the rocking movement of the switching guide, since the reverse rotation guide is shifted greatly, the severe manufacturing accuracy for the reverse rotation guide is not required. In addition, since the guide surface of the reverse rotation guide is spaced apart from the tray surface not to be accessible, the accuracy of the guide surface can be maintained. Further, since the reverse rotation guide can be rocked to some extent, space can be saved.

By providing the positive shifting means for positively rotating the reverse rotation guide to the retard position, when the sheet stacking tray is opened, even if the reverse rotation guide is trapped not to be moved freely, the reverse rotation guide can be rotated by the positive shifting means, thereby ensuring the correct and positive discharge of the sheet onto the sheet stacking tray.

Particularly when the positive shifting means is constituted by the protruded portion formed on the extension tray and the projection formed on the reverse rotation guide, as the extension tray is extended for use, since the positive shifting means is automatically operated to positively rotate the reverse rotation guide, the apparatus can be easily handled.

When the holding means is constituted by the extension tray slidably or rotatably mounted on the sheet stacking tray, as the extension tray is used, since the reverse-rotation guide is automatically released, the apparatus can be easily handled. Further, by providing the regulating means for holding the extension tray in the retracted position when the sheet stacking tray is closed, the erroneous operation such as the extending of the extension tray in an inoperative condition can be prevented, and the sheet can be discharged correctly and positively through the first sheet discharge path since the reverse rotation guide is held by the holding means.

When the holding means is constituted by the lock means for locking the reverse rotation guide to the body of the apparatus, the reverse rotation guide can positively be held with a simple construction. Particularly, when the lock means is constituted by the locking portion provided on the reverse rotation guide and the biasing means, the reverse rotation guide can be held with a simple construction when the sheet stacking tray is closed, and, the reverse rotation guide is positively shifted to the retard position by the biasing means when the sheet stacking tray is opened.

Further, when the sheet stacking tray is greatly rocked by releasing the positioning means upon the sheet jam, the jammed sheet can easily be removed through the greatly opened space.

When the sheet discharge apparatus is incorporated into the image forming apparatus, the face-down sheet discharge and the face-up sheet discharge can easily be switched without error.

DETAILED DESCRIPTION OF THE PREFERRED EMBODIMENTS

The present invention will now be explained in connection with embodiments thereof with reference to the accompanying drawings.

Figure 1:
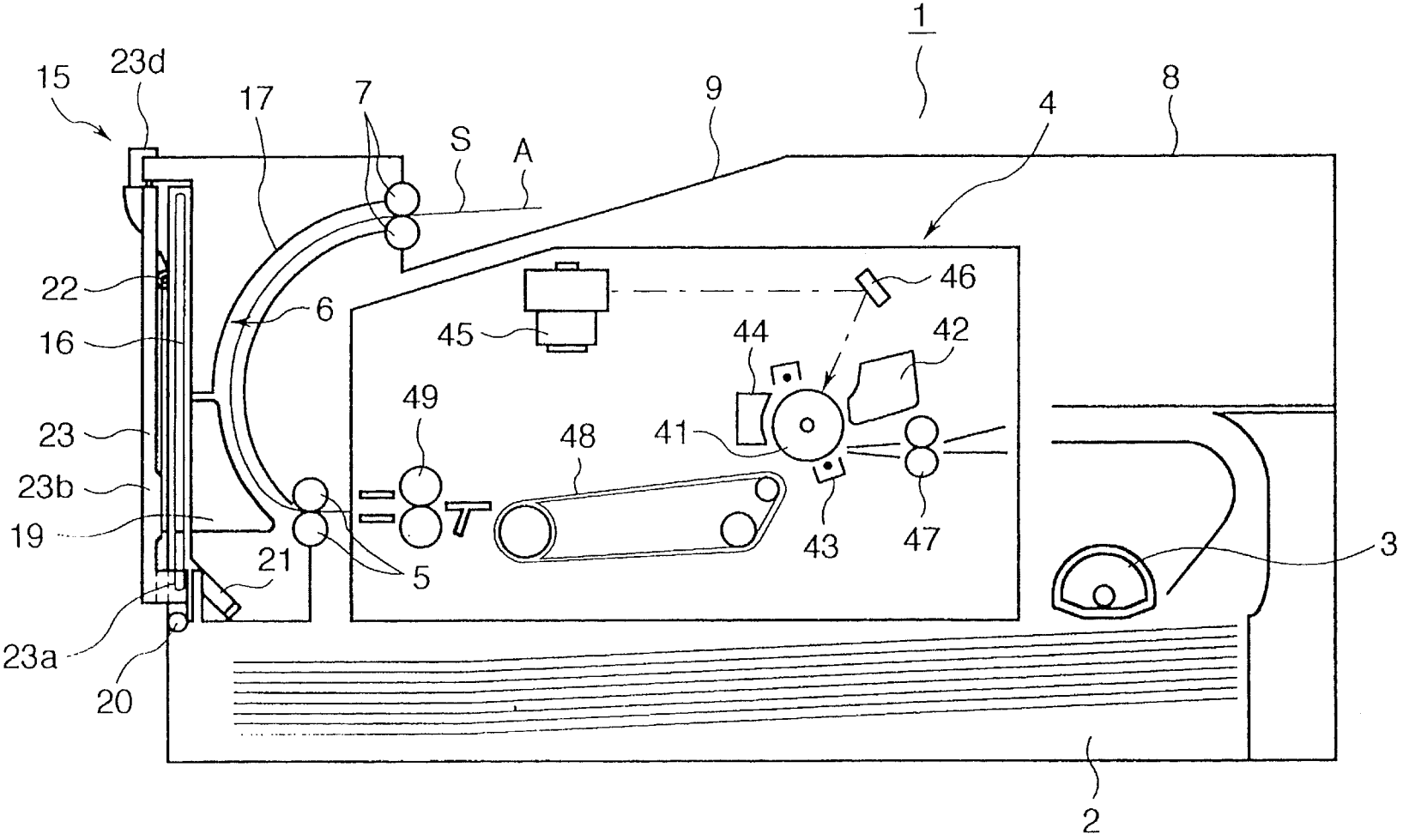
FIG. 1 is an elevational sectional view of an image forming apparatus according to a preferred embodiment of the present invention.

As shown in FIG. 1, an image forming apparatus 1 includes a sheet supply cassette 2 removably mounted on a body 8 of the apparatus, a sheet supply roller 3, an image forming portion 4 and a sheet discharge apparatus 15. The image forming apparatus 1 may be a printer, a copying machine, a facsimile system or the like, and may also be of optical type, electrostatic type, impact type, laser beam type, ink jet type, thermal type or the like. A sheet stacking portion 9 onto which a sheet is discharged in a face-down manner is formed on the body 8 of the image forming apparatus.

As an example, the image forming portion 4 includes a drum-shaped photosensitive member 41, a developing device 42, a transfer charger 43 and a cleaner 44. Light emitted from a scanner rotated by a scanner motor 45 is reflected by a reflection mirror 46 to be illuminated onto the photosensitive drum 41, thereby forming a latent image on the drum. The latent image is developed with toner from the developing device 42 to form a toner image. The toner image formed on the photosensitive drum 41 is transferred by the transfer charger 43 onto a sheet registered by a pair of regist rollers 47. Then, the sheet is sent, by a convey belt 48, to a fixing roller 49, where the transferred toner image is fixed to the sheet.

Figure 2:
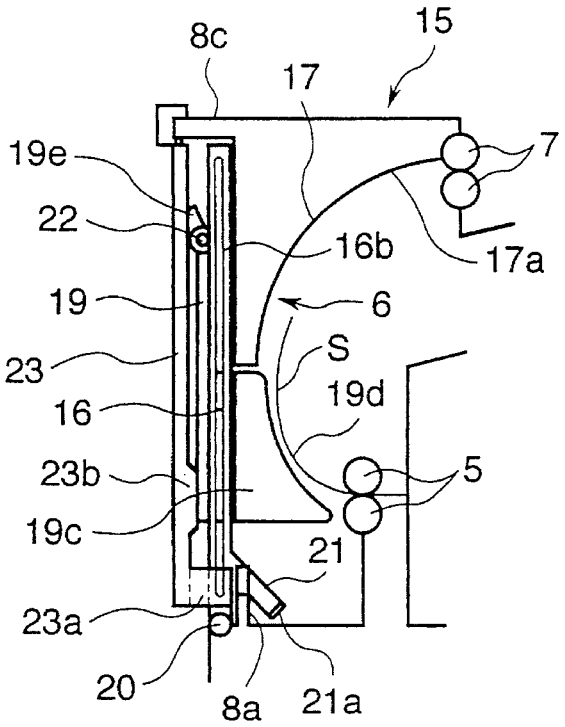
FIG. 2 is an elevational sectional view of a sheet discharge apparatus of the image forming apparatus.
Figure 3:
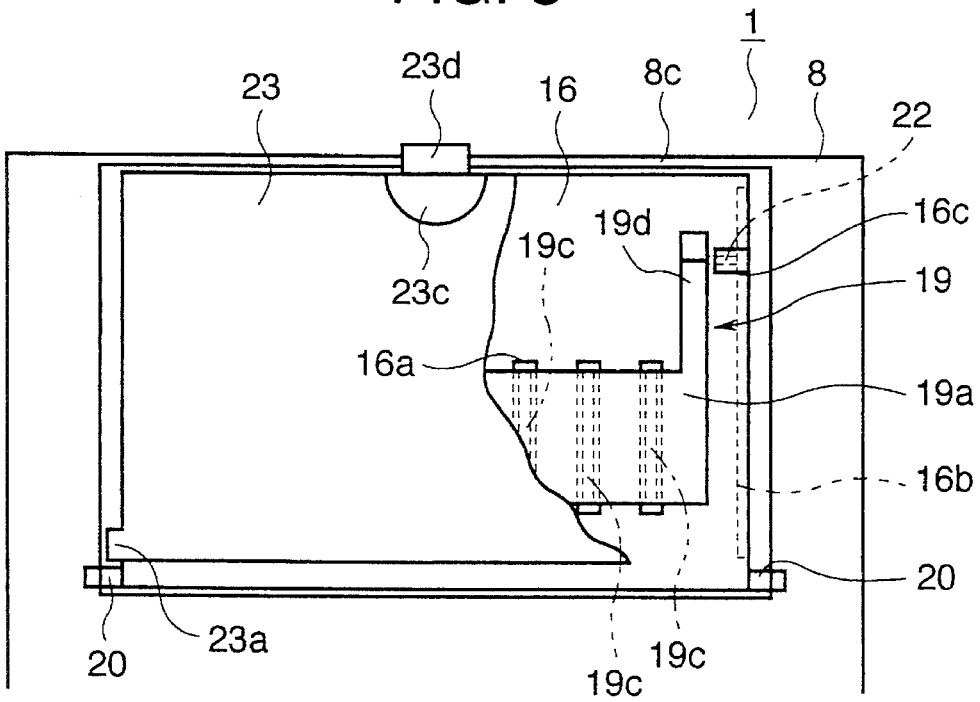
FIG. 3 is a side view of the sheet discharge apparatus.

As shown in FIGS. 2 and 3, the sheet discharge apparatus 15 comprises a pair of discharge rollers 5 for discharging the sheet on which the image was formed in the image forming portion 4, a pair of rollers 7 for discharging the sheet onto the sheet stacking portion 9, a sheet stacking tray 16 which can be opened and closed with respect to the apparatus body 8, a fixed reverse rotation guide 17 secured to the body 8, and a movable reverse rotation guide 19 pivotally mounted on the sheet stacking tray 16.

The sheet stacking tray 16 is pivotally mounted on the body 8 via a pivot pin 20 formed on a lower end of the tray, and a stopper 21 extending obliquely and downwardly is integrally formed on the lower end portion of the tray 16 so that, when a bent portion 21*a* of a tip end of the stopper 21 abuts against a projection 8*a* formed on the body 8, the opened position of the tray 16 is regulated. Thus, the stopper 21 and the projection 8*a* constitute a positioning means. Further, a plurality of slits 16*a* extending in a longitudinal direction (up-and-down direction) are formed in a central portion of the sheet stacking tray 16, and slide grooves 16*b* extending in the longitudinal direction are formed on both side surfaces of the sheet stacking tray 16.

The movable reverse rotation guide 19 has a body plate 19*a*, support arm portions 19*b* extending upwardly from the body plate at left and right ends of the body plate, and a plurality of guide portions 19*c* protruded from a front surface of the plate in a comb-shaped fashion. Tip ends of the support arm portions 19*b* are rotatably supported by boss portions 16*c* formed on a back surface of the sheet stacking tray 16 at its both sides via pins 22. The plurality of guide portions 19*c* are fitted into the slits 16*a* formed in the tray, respectively. A tip end surface 19*d* of each guide portion 19*c* is curved or arcuated so that the tip end surface cooperates with a corresponding tip end arcuated surface 17*a* of the fixed reverse rotation guide 17 to constitute the reverse rotation guide 6 for directing the sheet S to the rollers 7.

Incidentally, the reverse rotation guide 6 forms a first sheet discharge path, and, although the movable reverse rotation guide 19 preferably has the plurality of guide portions 19*c* protruded in the comb-shaped fashion, the movable reverse rotation guide may have one or several relatively wide guide portion(s). That is to say, guide portion(s) having a reverse rotation guide surface(s) at its tip end may be protuded from the back surface of the sheet stacking tray 16 toward the interior of the apparatus. Further, a protruded portion 19*e* is formed on each support arm portion 19*b* at a free end of the arm exceeding the corresponding pivot pin 22.

An extension tray 23 is slidably mounted on the back surface of the sheet stacking tray 16 in an overlapped relation. The extension tray 23 is provided at its lower end (on both sides thereof) with lugs 23*a*. A small piece is protruded inwardly from each lug 23*a* so that the extension tray 23 can be slid between an retracted position where the extension tray is overlapped with the sheet stacking tray 16 and an extended position where the extension tray is extended from the sheet stacking tray 16 by sliding the small pieces in the corresponding slide grooves 16*b*. Further, a protruded portion 23*b* is formed on a lower portion of the extension tray 23. When the sheet stacking tray 16 is closed with respect to the body 8 in a condition that the extension tray 23 is retracted onto the back surface of the sheet stacking tray 16, the protruded portion 23*b* abuts against a back surface of a plate portion 19*a* of the movable reverse rotation guide 19, thereby holding the reverse rotation guide 19 to a position where the reverse rotation guide 19 forms a part of the first sheet discharge path. Thus, the protruded portion 23*b* constitutes a holding means for holding the reverse rotation guide 19 to the position where the reverse rotation guide 19 forms a part of the first sheet discharge path.

Further, as the extension tray 23 is extended, the protruded portion 23*b* abuts against the protruded portion 19*e*, thereby shifting the guide portions 19*c* of the movable reverse rotation guide 19 along the slits 16*a* to positively shift the movable reverse rotation guide to a retard position where the movable reverse rotation guide does not prevent the sheet from being discharged onto the sheet stacking tray 16. Accordingly, the protruded portion 23*b* and the protruded portions 19*e* of the movable reverse rotation guide constitute a positive shifting means for positively shifting the reverse rotation guide to the retard position. However, the positive shifting means may be provided independently (i.e. not including the protruded portion 23*b* also acting as the holding means). Further, the positive shifting means may include the protruded portions 19*e* formed on the movable reverse rotation guide or/and an additional member cooperating with the protruded portions 19*e*. Incidentally, the protruded portions 19*e* constituting the positive shifting means may be omitted, and, when the sheet stacking tray 16 is opened, the reverse rotation guide 19 may be shifted to the retard position by its own weight or by a biasing force of a biasing means.

A gripper 23*c* is formed on an upper end of the extension tray 23, and a lock means 23*d* such as a snap-fit member is also provided. The lock means 23*d* is locked to an upper edge shelf 8*c* of the body 8 to position and lock the extension tray 23 and the sheet stacking tray 16 to the closed position. In the closed position, the upper edge shelf 8*c* of the body 8 covers the upper ends of the sheet stacking tray 16 and the extension tray 23 and constitutes a regulating means for regulating the sliding movement of the extension tray 23 in the extending direction and for holding the extension tray in the retracted position. Incidentally, the regulating means may be constituted by one or more pins formed on the body 8 and the like which can prevent the movement of the extension tray in the extending direction in the closed condition, in place of the upper edge shelf 8*c*.

Next, the operation of the image forming apparatus according to the illustrated embodiment will be explained.

The sheets are supplied one by one from the sheet supply cassette 2 by the sheet supply roller 3 to the image forming portion 4, where the image is formed on the upper surface of the sheet. Then, the sheet on which the image was formed is discharged into the sheet discharge apparatus 15 by means of the pair of discharge rollers 5.

When the face-down discharge is performed in the sheet discharge apparatus 15, as shown in FIGS. 1 to 3, the sheet stacking tray 16 is closed with respect to the apparatus body 8. In this case, the extension tray 23 is in the retracted position in the overlapped relation to the sheet stacking tray 16 and is locked at the closed position together with the sheet stacking tray 16 by means of the lock means 23*d*. In this condition, since the protruded portion 23*b* of the extension tray 23 abuts against the back surface of the movable reverse rotation guide 19 to regulate the rotation of the movable reverse rotation guide, with the result that the guide portions 19*c* of the movable reverse rotation guide cooperate with the fixed reverse rotation guide 17 to constitute the reverse rotation guide 6, and the movement of the extension tray 23 is prevented by the upper edge shelf 8*c*, thereby holding the reverse rotation guide 6 in place.

In the condition that the sheet stacking tray 16 is closed, the imaged sheet S discharged through the discharge rollers 5 is guided by the reverse rotation guide 6 constituted by the movable reverse rotation guide 19 and the fixed reverse rotation guide 17 and is discharged through the rollers 7 onto the sheet stacking portion 9 formed on the upper surface of the apparatus body 8 with the imaged surface A facing downwardly.

Thus, in the condition that the sheet stacking tray 16 is closed the sheet is automatically discharged onto the sheet stacking portion 9 in the face-down discharge manner. Accordingly, the erroneous manipulation of the operator can be eliminated, and, since the sheet is directed toward the sheet stacking portion by the movable reverse rotation guide 19, the occurrence of the sheet jam is reduced. Further, even when the face-down discharge is used in the sheet discharge apparatus, since the sheet stacking tray 16 is held in the closed position, there is no danger of missing the tray. In addition, since the movable reverse rotation guide 19 is correctly and positively held at the position where the movable reverse rotation guide forms a part of the reverse rotation guide 6 and the movement of the extension tray 23 is regulated, the face-down sheet discharge can be effected positively and correctly.

As mentioned above, even if the movable reverse rotation guide 19 is not mechanically held by the protruded portion 23*b* of the extension tray 23 and the like, when the sheet stacking tray 16 is in the closed position, the movable reverse rotation guide 19 may be shifted to the reverse rotation guide forming position by its own weight. In this case, the gravity force acting on the reverse rotation guide 19 (and the position of the pivot pin 22) and/or the positioning member for abutting the plate portion 19*a* against the back surface of the sheet stacking tray 16 constitute the holding means.

Figure 4:
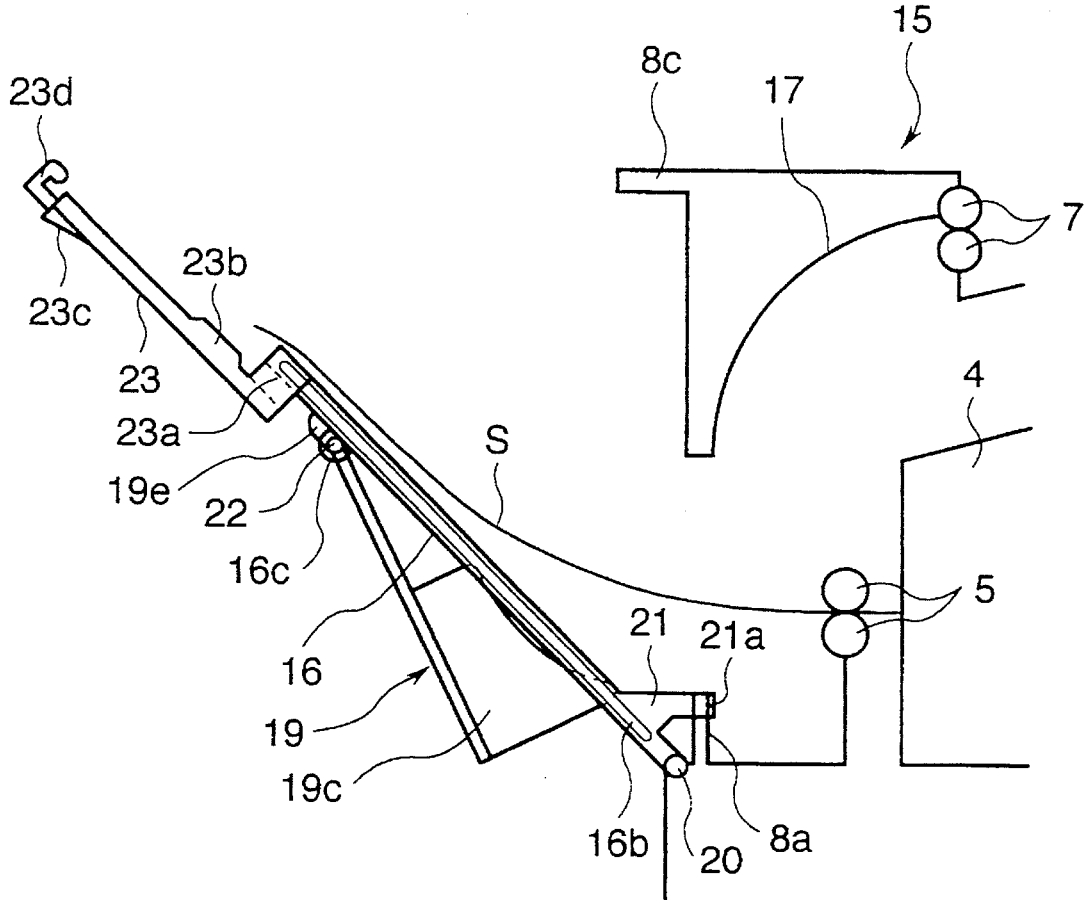
FIG. 4 is an elevational sectional view of the sheet discharge apparatus showing a condition that a sheet stacking tray is opened.

On the other hand, when the face-up discharge is effected in the sheet discharge apparatus 15, as shown in FIG. 4, the sheet stacking tray 16 is opened with respect to the apparatus body 8. In this case, by strongly pulling the sheet stacking tray 16 through the gripper 23*c*, the lock means 23*d* (elastic locking means such as a snap-fit member) is released, with the result that the tip end bent portion 21*a* of the stopper 21 abuts against the projection 8*a* of the body 8, thereby limiting the inclination angle of the sheet stacking tray 16 to a predetermined angular value. In this condition, the extension tray 23 is shifted upwardly by sliding the small pieces on the lugs 23*a* along the slide grooves 16*b* of the sheet stacking tray 16, thereby increasing the sheet stacking area.

As the extension tray 23 is shifted, the protruded portion 23*b* of the extension tray 23 is firstly disengaged from the movable reverse rotation guide 19 so that the movable reverse rotation guide 19 is released to be freely rotated by its own weight, and, then, the protruded portion 23*b* abuts against the protruded portion 19*e* of the reverse rotation guide 19, with the result that, since the guide portions 19*c* are slid along the slits 16*a*, the reverse rotation guide 19 is positively shifted to the retard position where the sheet is not prevented by the reverse rotation guide from being directed toward the sheet stacking tray 16 (i.e. a position where the reverse rotation guide 19 is retracted from the surface of the tray 16 not to be accessed). In the retard position, the further rotation of the reverse rotation guide 19 is prevented by abutting the protruded portion 19*e* against the back surface of the sheet stacking tray, thereby positioning the stacking tray 16. Incidentally, if the guide surface 19*d* is separated from the surface of the tray 16 and lowered to some extent, inadvertent access to the guide surface 19*d* can be prevented.

When the sheet stacking tray 16 is in the opened position, the imaged sheet S discharged through the discharge rollers 5 is directed to the sheet stacking tray 16 with the imaged surface facing upwardly and is discharged onto the sheet stacking tray 16 and the extension tray 23 in the face-up manner.

Thus, since the sheet is automatically directed to the sheet stacking tray 16 when the latter is opened, the erroneous manipulation can surely be prevented. Further, when the movable reverse rotation guide 19 is in the retard position, since the discharge of the sheet S is not prevented by the reverse rotation guide, the sheet S can be directed to the sheet stacking tray 16 and the extension tray 23 correctly and positively. In addition, since the reverse rotation guide 19 is positively shifted to the retard position by the positive shifting means (such as the protruded portions 23*b*, 19*e*), if the reverse rotation guide cannot be freely moved due to the clogging between the guide portions 19*c* and the slits 16*a*, the reverse rotation guide 19 can surely be shifted to the retard position.

Incidentally, it is not necessary to provide the positive shifting means. When there is no positive shifting means, the reverse rotation guide 19 can be shifted to the retard position by its own weight as the sheet stacking tray 16 is opened.

Figure 5:
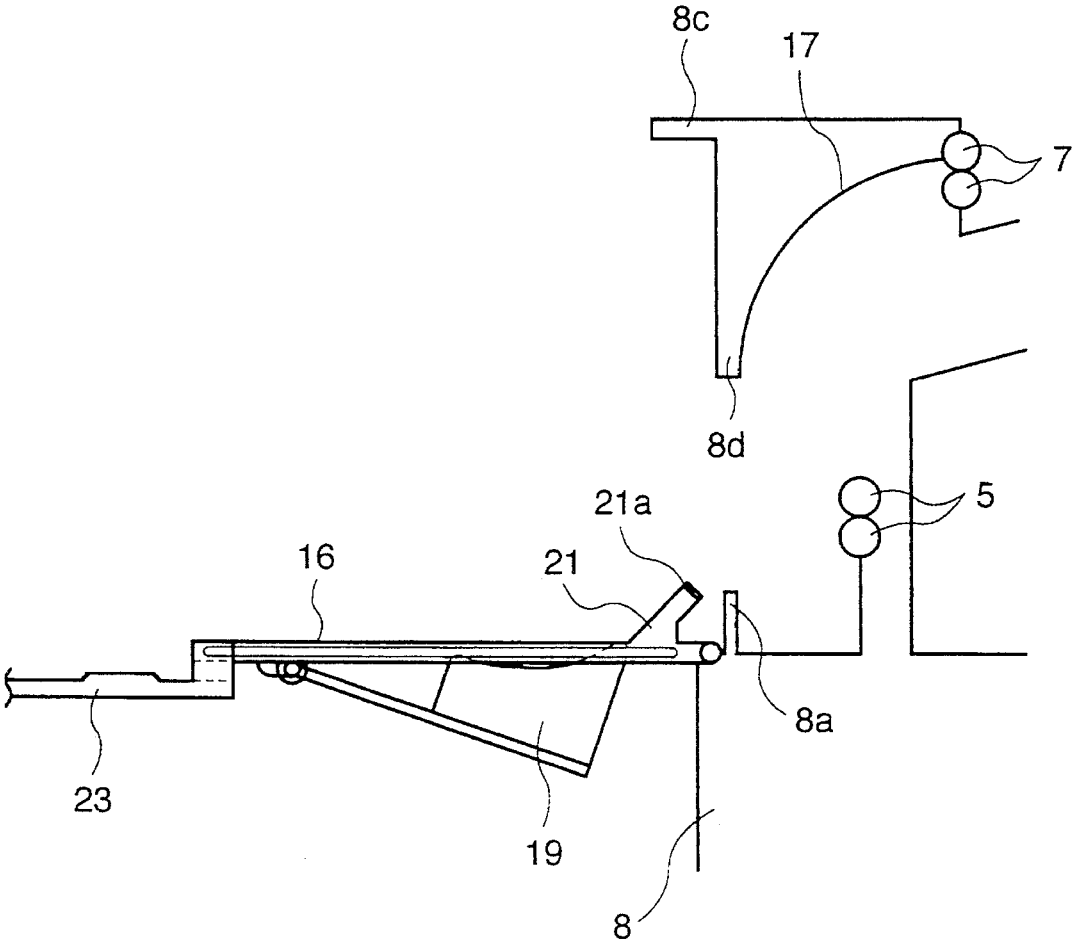
FIG. 5 is an elevational sectional view of the sheet discharge apparatus showing a condition that a sheet stacking tray is further opened for jam treatment.

If the sheet is jammed in the sheet discharge apparatus 15, as shown in FIG. 5, by flexing the stopper 21 made of synthetic resin (of the sheet stacking tray 16), the bent portion 21*a* is disengaged from the projection 8*a*. Thereafter, the sheet stacking tray 16 is further rotated. As a result, since an opening 8*d* of the body 8 of the sheet discharge apparatus 15 is greatly exposed, the jammed sheet can easily be removed through the opening 8*d*.

Next, another embodiment will be explained with reference to FIG. 6. Since this embodiment is the same as the aforementioned embodiment except for an extension tray, the same elements as those in the aforementioned embodiment are designated by the same reference numerals and explanation thereof will be omitted.

In this embodiment, lugs 16*e* are formed on the free end of the sheet stacking tray 16 at its both sides, and an extension tray 23 is pivotally connected to the lugs 16*e* via pins 25. In an extended position shown in FIG. 6, the extension tray 23 is positioned by a stopper and the like. On the other hand, in a retracted position, the extension tray is locked by a lock means such as a snap-fit member.

With this arrangement, according to this embodiment, when the face-down sheet discharge is effected by closing the sheet stacking tray 16, the extension tray is in the retracted position where the extension tray 23 abuts against the back surface of the movable reverse rotation guide 19 and the latter forms a part of the reverse rotation guide 6. Accordingly, the extension tray itself constitutes the holding means.

Figure 6:
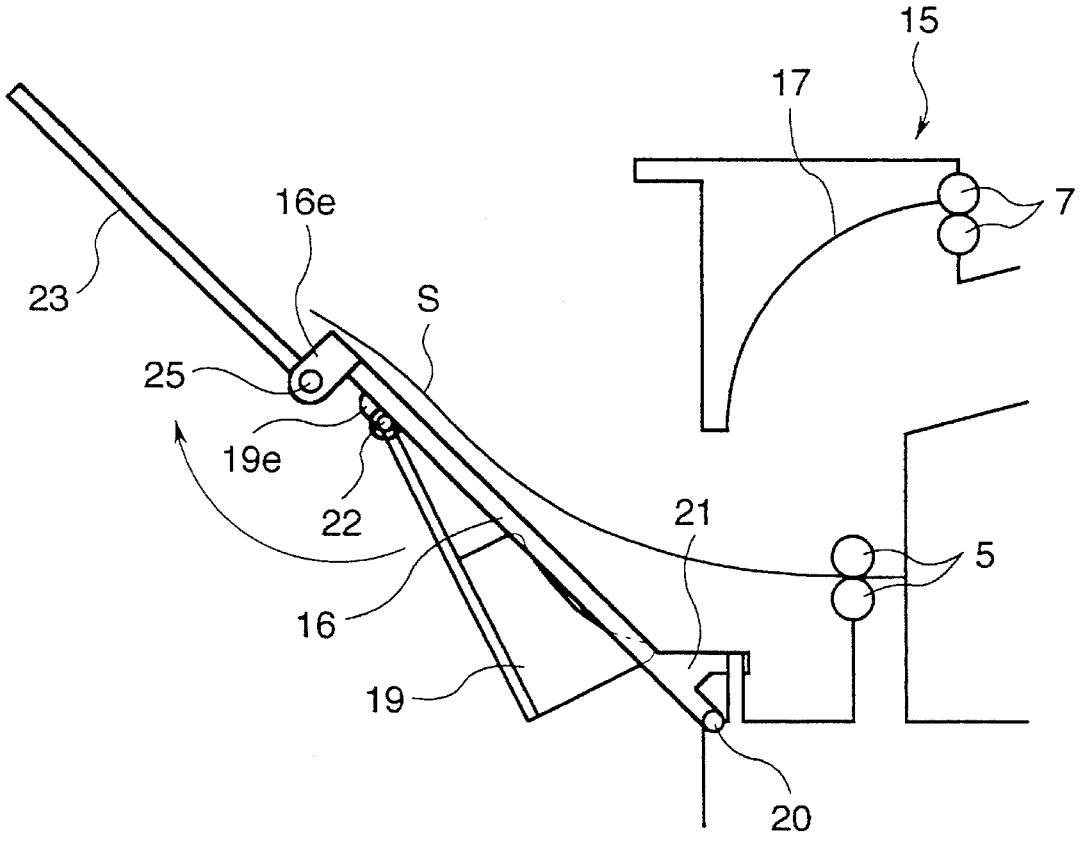
FIG. 6 is an elevational sectional view of a sheet discharge apparatus having an extension tray according to an alteration.

On the other hand, as shown in FIG. 6, when the face-up sheet discharge is effected by opening the sheet stacking tray 16, the extension tray 23 is rotated in a direction shown by the arrow to be brought to the extended position. As the extension tray is rotated, the holding of the movable reverse rotation guide 19 is released, with the result that the guide 19 is automatically rotated to the retard position by its own weight. Incidentally, if the reverse rotation guide 19 is caught not to be moved freely, by pushing the projection 19*e*, the reverse rotation guide 19 is positively shifted. Thus, in this case, the projection 19*e* constitutes the positive shifting means.

This embodiment can achieve the same advantage as that of the aforementioned embodiment, and further, since the extension tray 23 is supported by the support pins 25 which are advantageous in design, the extension tray 23 can be strongly formed with a simple construction.

Next, a further embodiment will be explained with reference to FIGS. 7 and 8. Incidentally, the same elements as those in the above-mentioned embodiments are designated by the same reference numerals and explanation thereof will be omitted.

In this embodiment, an extension tray is not provided on the sheet stacking tray 16. As is in the above-mentioned embodiment, although the movable reverse rotation guide 19 has the plate portion 19*a*, arm portions 19*b* and guide portions 19*c*, a projection 19*f* is further formed on an upper end of each guide portion 19*c*, and a coil spring 26 is disposed between a recess formed in the back surface of the sheet stacking tray 16 and the plate portion 19*a*. The spring 26 constitutes a biasing means for biasing the movable reverse rotation guide 19 toward the retard position where the sheet is not prevented by the reverse rotation guide from being directed to the sheet stacking tray 16. However, the biasing means is not limited to the coil spring 26, but may comprise another spring such as a torsion spring or an elastic member such as rubber, or the like.

In a pivot portion for supporting the sheet stacking tray 16, there is provided an accommodation mechanism (for example, the support pin 20 is formed from an elastic pin, or the support pin 20 is fitted into a slot with slight play) so that the sheet stacking tray 16 is supported by the accommodation mechanism for minute movement in an up-and-down direction. When the sheet stacking tray 16 is in the closed position, by locking the sheet stacking tray by the lock means 23*d* such as a snap-fit member, the sheet stacking tray 16 and the movable reverse rotation guide 19 are slightly lifted, thereby engaging the projections 19*f* with the end of the fixed reverse rotation guide 17. This condition is maintained by the spring 26. Accordingly, the locking portions comprising the projections 19*f*, and the biasing means 26 constitute the holding means for holding the movable reverse rotation guide 19 in the reverse rotation guide forming position.

Figure 7:
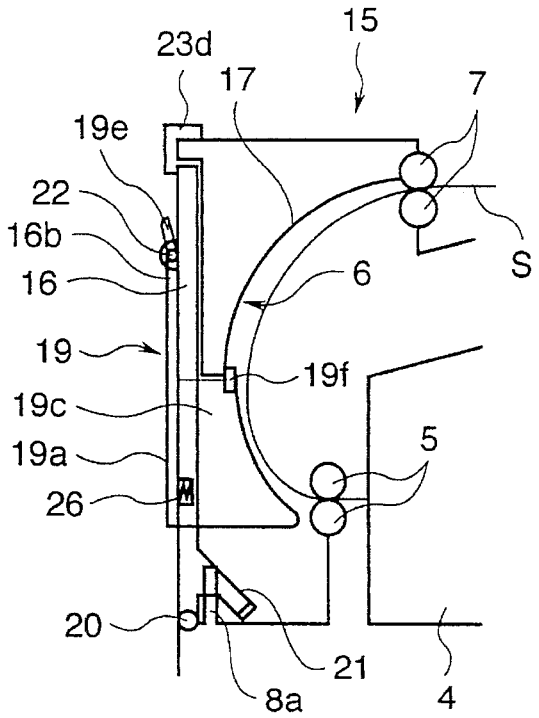
FIG. 7 is an elevational sectional view of a sheet discharge apparatus having an extension tray according to a further alteration, showing a condition that a sheet stacking tray is closed.

With this arrangement, as shown in FIG. 7, when the face-down sheet discharge is effected by closing the sheet stacking tray 16, the sheet stacking tray 16 is locked to the closed position by the lock means 23*d*. In this case, when the back surface of the movable reverse rotation guide 19 is pushed in opposition to the spring 26, the sheet stacking tray 16 and the movable reverse rotation guide 19 are slightly lifted through the accommodation mechanism, thereby engaging the projections 19*f* with the end of the fixed reverse rotation guide 17. Accordingly, the sheet discharged through the discharge rollers 5 is guided by the reverse rotation guide 6 constituted by the fixed and movable reverse rotation guides 17, 19, and is discharged onto the sheet stacking portion 9 through the rollers 7.

Figure 8:
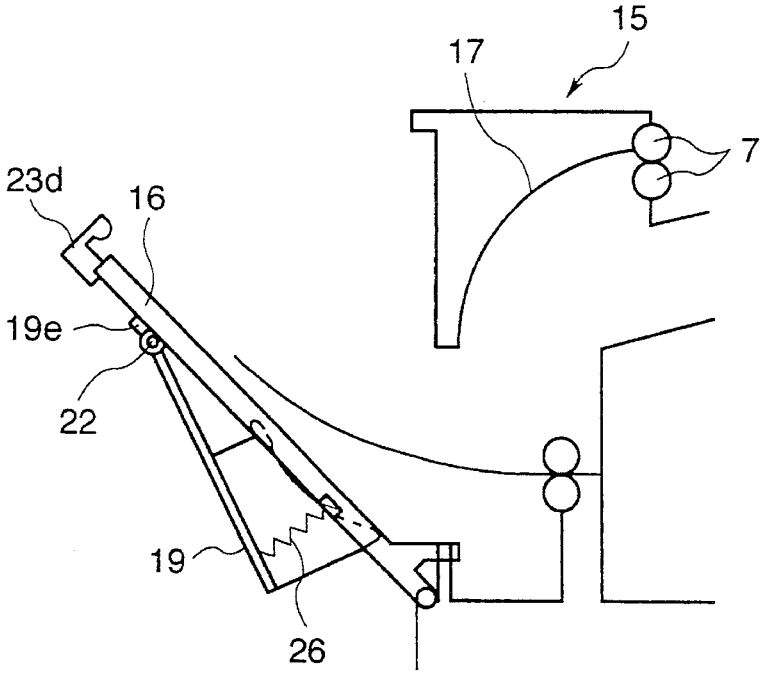
FIG. 8 is an elevational sectional view of the sheet discharge apparatus showing a condition that the sheet stacking tray is opened.
Figure 9:
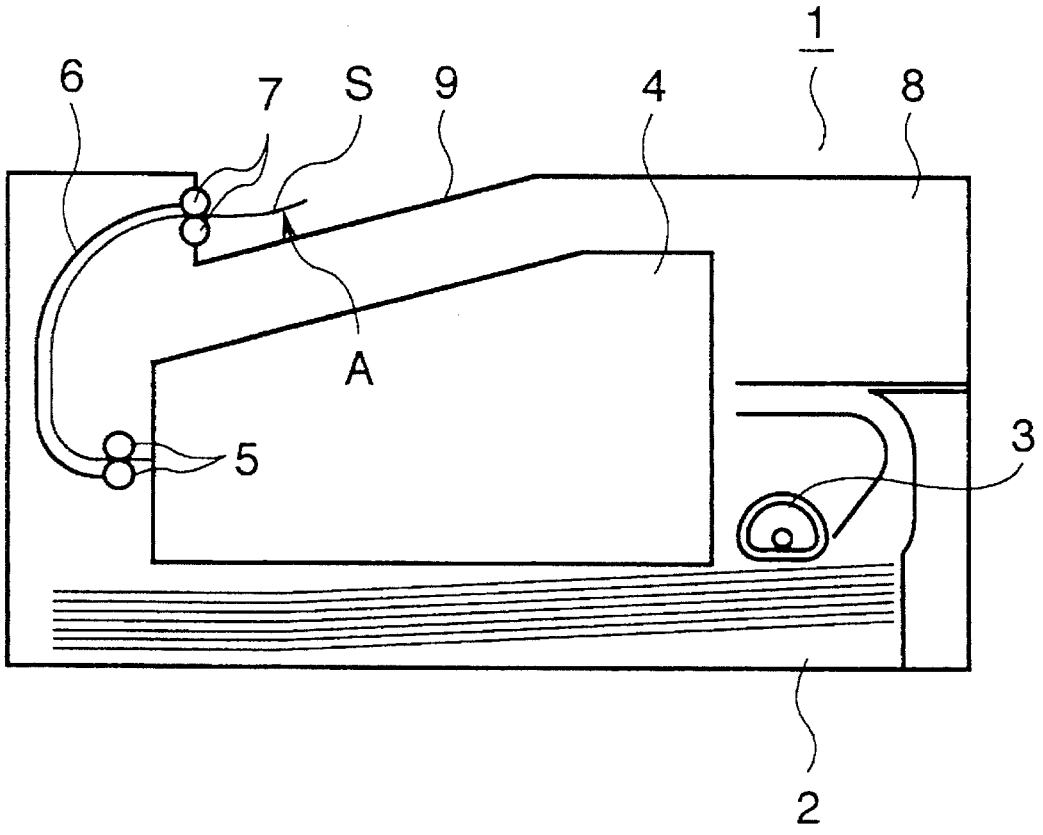
FIG. 9 PRIOR ART
FIG. 9 is a schematic elevational view of a conventional image forming apparatus of face-down sheet discharge type.
Figure 10:
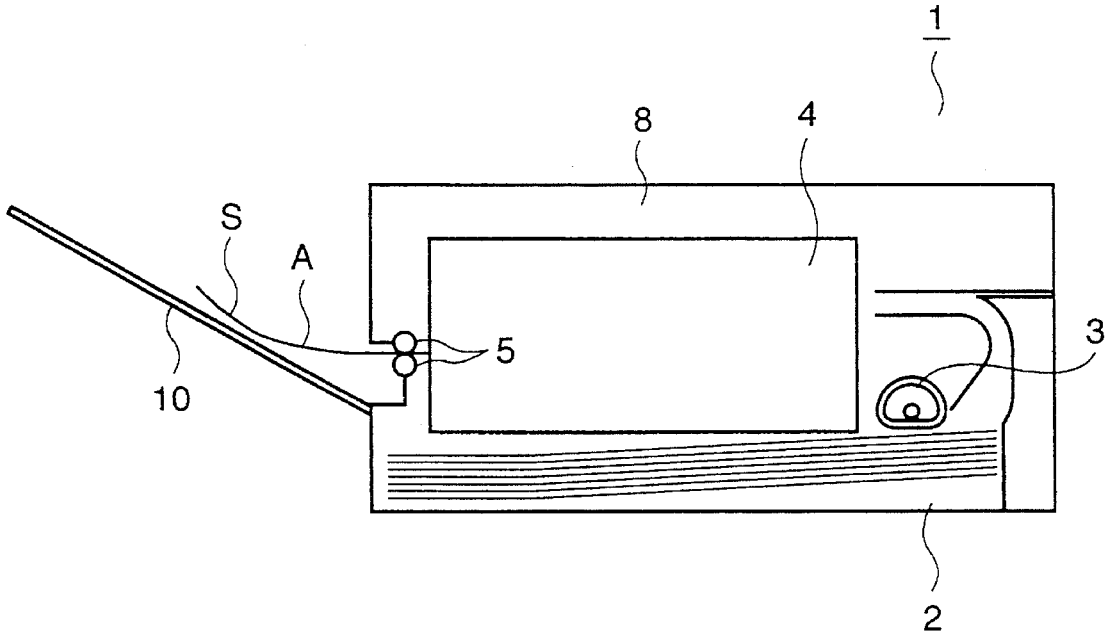
FIG. 10 PRIOR ART
FIG. 10 is a schematic elevational view of a conventional image forming apparatus of face-up sheet discharge type.
Figure 11:
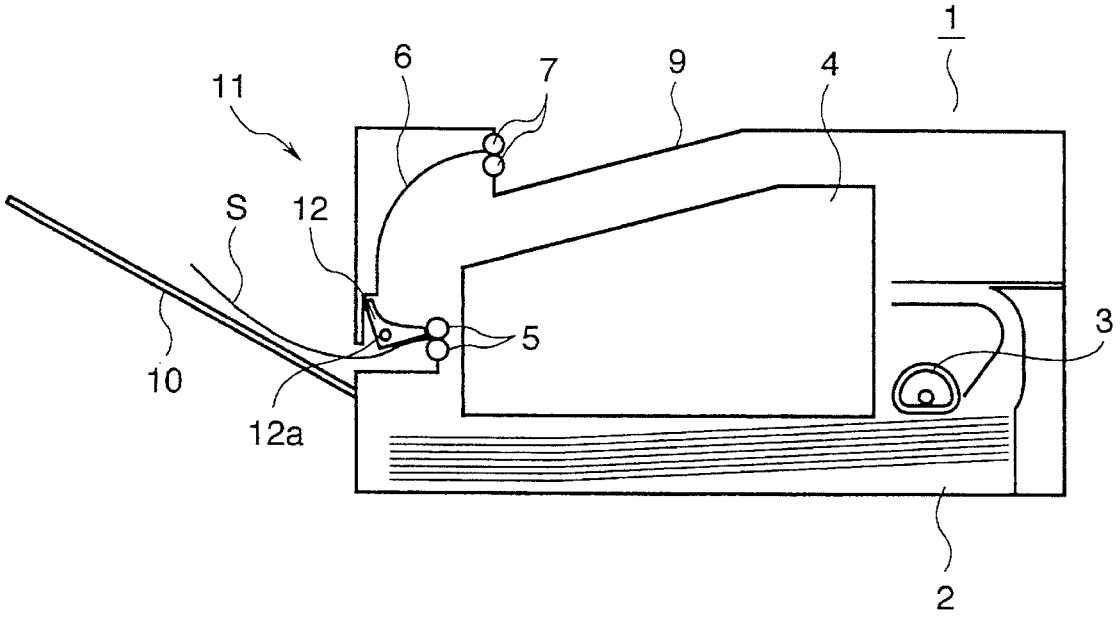
FIG. 11 PRIOR ART
FIG. 11 is a schematic elevational view of a conventional image forming apparatus wherein the face-down sheet discharge and the face-up sheet discharge can be switched.
Figure 12:
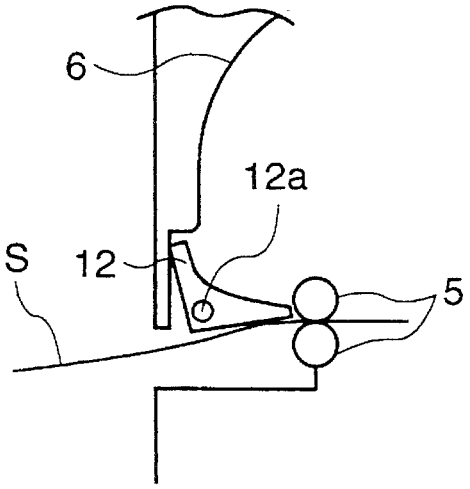
FIG. 12 PRIOR ART
FIG. 12 is an enlarged view showing the face-up sheet discharge.
Figure 13:
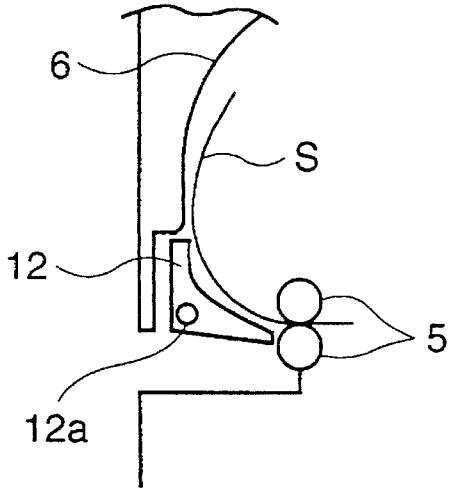
FIG. 13 PRIOR ART
FIG. 13 is an enlarged view showing the face down sheet discharge.
Figure 14A:
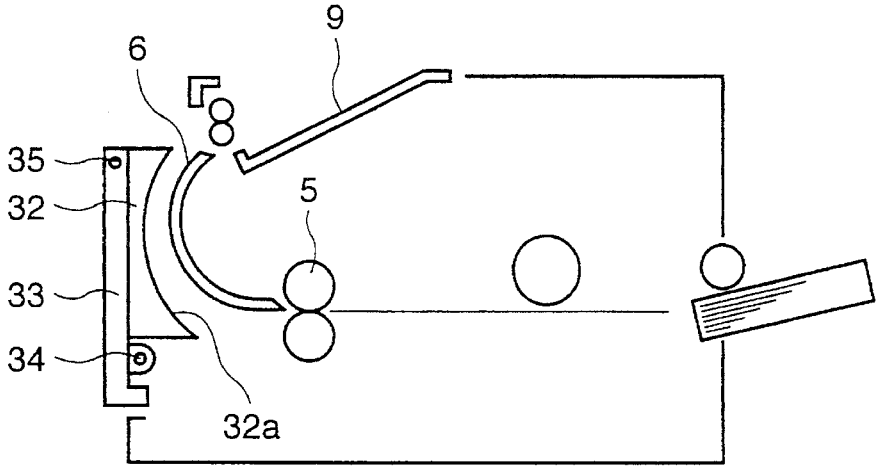
FIG. 14A PRIOR ART
FIG. 14A is a schematic elevational view of other conventional image forming apparatus showing the face-down sheet discharge.
Figure 14B:
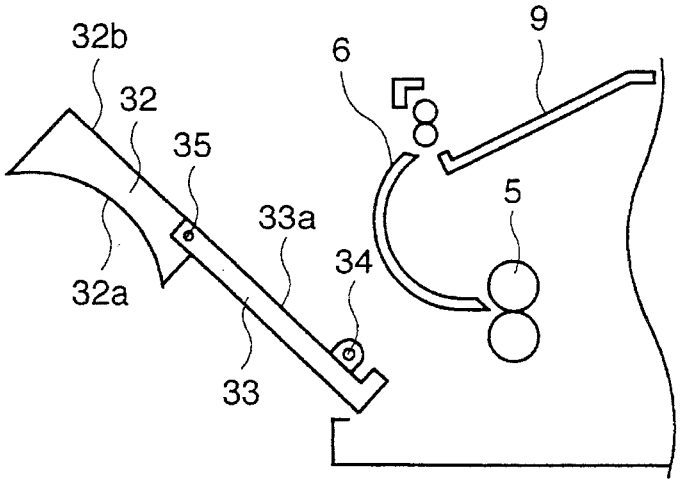
FIG. 14B PRIOR ART
FIG. 14B is a view similar to FIG. 14A, but showing the face-up sheet discharge.

On the other hand, as shown in FIG. 8, when the face-up sheet discharge is effected by opening the sheet stacking tray 16, the sheet stacking tray 16 is released from the lock means 23*d*. In this case, the sheet stacking tray 16 and the movable reverse rotation guide 19 are slightly lowered through the accommodation mechanism, thereby disengaging the projections 19*f* from the end of the fixed reverse rotation guide 17, with the result that the reverse rotation guide 19 is rotated to the retard position by the biasing force of the spring 26 and the weight of the guide itself and is positioned at the retard position by the projection 19*e*. Accordingly, the sheet discharged through the discharge rollers 5 is discharged onto the opened sheet stacking tray 16 without being blocked by the movable reverse rotation guide 19.

This embodiment can achieve the same advantage as that of the aforementioned embodiment, and further, a simple construction without any extension tray can be also achieved. Further, the movable reverse rotation guide 19 can surely be held in the reverse rotation guide forming position by the simple lock means comprised of the projections 19*f* on the movable reverse rotation guide 19 and the spring 26. According to this embodiment, when the tray 16 is opened, the reverse rotation guide 19 can be switched automatically.

Incidentally, while an example that the projections 19*f* constitute the lock means for locking the movable reverse rotation guide to the apparatus body 8 was explained, the lock means is not limited to such an example, but may be constituted by a fixing means such as a snap-fit member and a screw for securing the movable reverse rotation guide 19 to the back surface of the sheet stacking tray 16. In this case, the holding function can be achieved by the lock means alone.

What is claimed is:

1. A sheet discharge apparatus comprising:

a first sheet discharge path for discharging a sheet;

a second sheet discharge path for discharging the sheet;

a sheet stacking tray on which the sheets discharged through said second sheet discharge path are stacked and which is pivotally mounted on a body of the apparatus;

a guide rockably supported by said sheet stacking tray so as to protrude from or to drop below said sheet stacking tray, and forming a part of said first sheet discharge path; and a holding means for holding said guide in a position where said guide forms a part of said first sheet discharge path in a condition that said sheet stacking tray is closed with respect to a body of the apparatus, and for releasing said guide to drop to a position below a stacking surface of said sheet stacking tray so as not to prevent a sheet from being directed to said sheet stacking tray.

2. A sheet discharge apparatus according to claim 1, wherein said first sheet discharge path serves to discharge the sheet with a first surface thereof facing downwardly, and said second sheet discharge path serves to discharge the sheet with the first surface thereof facing upwardly.

3. A sheet discharge apparatus according to claim 1, further comprising a positive shifting means for positively shifting said guide to the retard position where the sheet discharged from said second sheet discharge path is not prevented from being directed to said sheet stacking tray when said sheet stacking tray is opened with respect to the body of the apparatus.

4. A sheet discharge apparatus according to claim 1, wherein said holding means comprises an extension tray provided in connection with said sheet stacking tray, and when said extension tray is retracted, it holds said guide, and, when said extension tray is extended, said guide can be retarded.

5. A sheet discharge apparatus according to claim 4, wherein said extension tray is slidably mounted on said sheet stacking tray, and an abutment portion is provided on said extension tray and an abut portion is provided on said guide, and wherein said abutment portion and said abut portion constitute a positive shifting means in which, when said extension tray is shifted from the retracted position to the extended position, said abutment portion abuts against said abut portion to positively shift said guide to the retard position.

6. A sheet discharge apparatus according to claim 4, wherein said extension tray is rockable with respect to said sheet stacking tray.

7. A sheet discharge apparatus according to claim 5, further comprising a regulating means for holding said extension tray to the retracted position when said sheet stacking tray is closed with respect to the body of the apparatus.

8. A sheet discharge apparatus according to claim 1, wherein said holding means comprises lock means for locking said guide to the body of the apparatus.

9. A sheet discharge apparatus according to claim 8, wherein said lock means comprises a lock portion provided on said guide and a biasing means for biasing said guide to the position where said guide does not prevent the sheet from being directed to said sheet stacking tray, and when said lock portion is locked to the body of the apparatus in opposition to a biasing force of said biasing means, said guide is held the position where said guide forms a part of said first sheet discharge path.

10. A sheet discharge apparatus according to any one of claims 1 to 9, further comprising positioning means for positioning said sheet stacking tray to a sheet stacking position where the sheets discharged from said second sheet discharge path can be stacked, and wherein said sheet stacking tray can be further opened from the sheet stacking position.

11. A sheet discharge apparatus according to any one of claims 3, 4 or 8, wherein said first sheet discharge path comprises a curved path and serves to discharge the sheet with a first surface thereof facing downwardly, said second sheet discharge path serves to discharge the sheet with the first surface thereof facing upwardly, and said guide serves to reverse front and rear surfaces of the sheet.

12. An image forming apparatus comprising:

an image forming portion; and a sheet discharge portion for discharging a sheet on which an image was formed in said image forming portion, said sheet discharge portion comprising:

a first sheet discharge path for discharging the sheet;

a second sheet discharge path for discharging the sheet;

a sheet stacking tray on which the sheets discharged through said second sheet discharge path are stacked and which is pivotally mounted on a body of the apparatus;

a guide rockably supported by said sheet stacking tray so as to protrude from or to drop below said sheet stacking tray, and forming a part of said first sheet discharge path; and a holding means for holding said guide in a position where said guide forms a part of said first sheet discharge path in a condition that said sheet stacking tray is closed with respect to a body of the apparatus, and for releasing said guide to drop to a position below a stacking surface of said sheet stacking tray so as not to prevent a sheet from being directed to said sheet stacking tray.

13. An image forming apparatus according to claim 12, wherein said first sheet discharge path serves to discharge the sheet with a first surface thereof facing downwardly, and said second sheet discharge path serves to discharge the sheet with the first surface thereof facing upwardly.

14. An image forming apparatus according to claim 12, further comprising a positive shifting means for positively shifting said guide to the retard position where the sheet discharged from said second sheet discharge path is not prevented from being directed to said sheet stacking tray when said sheet stacking tray is opened with respect to the body of the apparatus.

15. An image forming apparatus according to claim 12, wherein said holding means comprises an extension tray provided in connection with said sheet stacking tray, and when said extension tray is retracted, it holds said guide, and, when said extension tray is extended, said guide can be retarded.

16. An image forming apparatus according to claim 15, wherein said extension tray is slidably mounted on said sheet stacking tray, and an abutment portion is provided on said extension tray and an abut portion is provided on said guide, and wherein said abutment portion and said abut portion constitute a positive shifting means in which, when said extension tray is shifted from the retracted position to the extended position, said abutment portion abuts against said abut portion to positively shift said guide to the retard position.

17. An image forming apparatus according to claim 16, further comprising a regulating means for holding said extension tray to the retracted position when said sheet stacking tray is closed with respect to the body of the apparatus.

18. An image forming apparatus according to claim 15, wherein said extension tray is rockable with respect to said sheet stacking tray.

19. An image forming apparatus according to claim 12, wherein said holding means comprises a lock means for locking said guide to the body of the apparatus.

20. An image forming apparatus according to claim 19, wherein said lock means comprises a lock portion provided on said guide and a biasing means for biasing said guide to the position where said guide does not prevent the sheet from being directed to said sheet stacking tray, and when said lock portion is locked to the body of the apparatus in opposition to a biasing force of said biasing means, said guide is held the position where said guide forms a part of said first sheet discharge path.

21. An image forming apparatus according to any one of claims 12 to 20, further comprising positioning means for positioning said sheet stacking tray to a sheet stacking position where the sheets discharged from said second sheet discharge path can be stacked, and wherein said sheet stacking tray can be further opened from the sheet stacking position.

22. A sheet discharge apparatus according to any one of claims 14, 15 or 19, wherein said first sheet discharge path comprises a curved path and serves to discharge the sheet with a first surface thereof facing downwardly, said second sheet discharge path serves to discharge the sheet with the first surface thereof facing upwardly, and said guide serves to reverse front and rear surfaces of the sheet.

* * * * *

UNITED STATES PATENT AND TRADEMARK OFFICE

CERTIFICATE OF CORRECTION

PATENT NO. : 5,586,758

DATED : December 24, 1996

INVENTOR(S) : KIMURA, ET AL.

It is certified that error appears in the above-indentified patent and that said Letters Patent is hereby corrected as shown below:

On the title page, item:

[56] REFERENCES CITED

FOREIGN PATENT DOCUMENTS

"404023763 1/1992 Japan.
404308148 10/1992 Japan.
40501160 5/1993 Japan."

Should read:

-- 4-23763 1/1992 Japan.
4-308148 10/1992 Japan.
5-51160 5/1993 Japan.--

COLUMN 13

Line 16, "held the" should read --held at the--.

COLUMN 14

Line 42, "held the" should read --held at the--.

UNITED STATES PATENT AND TRADEMARK OFFICE

CERTIFICATE OF CORRECTION

PATENT NO. : 5,586,758 Page 2 of 2

DATED : December 24, 1996

INVENTOR(S) : KIMURA, ET AL.

It is certified that error appears in the above-indentified patent and that said Letters Patent is hereby corrected as shown below:

COLUMN 14

Line 51, "A sheet discharge" should read --An image forming--.

Signed and Sealed this

Twenty-fourth Day of June, 1997

Bruce Lehman

*Attest:*

BRUCE LEHMAN

*Attesting Officer*

*Commissioner of Patents and Trademarks*